United States Patent [19]

Kawashima

[11] 4,368,989

[45] Jan. 18, 1983

[54] ELECTRONIC TIMEPIECE HAVING A SYSTEM FOR AUDIBLE GENERATION OF A MELODY

[75] Inventor: Hideyuki Kawashima, Tanashi, Japan

[73] Assignee: Citizen Watch Company Limited, Tokyo, Japan

[21] Appl. No.: 179,354

[22] Filed: Aug. 18, 1980

[30] Foreign Application Priority Data

Aug. 24, 1979 [JP] Japan ..... 54-107185
Dec. 25, 1979 [JP] Japan ..... 54-167534

[51] Int. Cl.[3] ..... G04B 23/02; G04C 19/00; G10G 3/04

[52] U.S. Cl. ..... 368/74; 368/82; 368/273; 84/1.03

[58] Field of Search ..... 368/72–75, 368/250, 251, 272–273; 340/384 E; 84/1.01, 470, 477

[56] References Cited

U.S. PATENT DOCUMENTS

| | | | |
|---|---|---|---|
| 4,090,349 | 5/1978 | Takase | 84/1.01 X |
| 4,213,372 | 7/1980 | Sasaki et al. | 84/470 R |
| 4,267,586 | 5/1981 | Uchino et al. | 368/73 |
| 4,282,593 | 8/1981 | Flaig et al. | 368/63 |
| 4,307,645 | 12/1981 | Radchi | 84/470 R |

*Primary Examiner*—Vit W. Miska
*Attorney, Agent, or Firm*—Jordan and Hamburg

[57] ABSTRACT

In an electronic timepiece equipped with a liquid crystal display, means are provided whereby the user can input a freely selected sequence of musical notes to be stored in a memory circuit, to thereby compose a melody, and whereby this melody can be subsequently emitted in audible form when coincidence occurs between a preset alarm time and the current time. Visible monitoring of information specifying the pitch and duration of each note is enabled when a melody is being input, by means of liquid crystal display patterns, together with audible monitoring.

15 Claims, 10 Drawing Figures

| Fig. 6 A | Fig. 6 B | Fig. 6 C |
|---|---|---|

| Fig. 7A | Fig. 7B |
|---|---|

ELECTRONIC TIMEPIECE HAVING A SYSTEM FOR AUDIBLE GENERATION OF A MELODY

BACKGROUND OF THE INVENTION

At the present time, electronic timepieces having liquid crystal display means are widely utilized. Many of such timepieces are equipped with means for generating an audible alarm signal when coincidence occurs between the current time and a preset alarm time. Usually this audible alarm signal comprises a simple type of signal such as a buzzer tone. However some timepieces equipped with an alarm function have been produced in which a simple sequence of notes, i.e. a melody, is audibly generated as an alarm signal. With such timepieces, the melody to be thus generated is predetermined at the time of manufacture of the timepiece. However it would be desirable for an electronic timepiece to be provided with means whereby the user can record any melody which he or she desires to have generated as an alarm time signal. No timepiece equipped with such a feature is described in the prior art. It will be apparent that the provision of such a feature would considerably enhance the market appeal of such an electronic timepiece. The present invention is directed towards the provision of an electronic timepiece equipped with such means whereby the user can store a freely determined melody to be subsequently generated at a preset alarm time. It is a further feature of the present invention that the user is enabled to monitor each note of the melody as it is input both audibly and visibly.

SUMMARY OF THE INVENTION

The present invention comprises an electronic timepiece equipped with liquid crystal display for indication of time information in digital form, which may also serve to indicate calendar information. The timepiece further incorporates an alarm circuit whereby an alarm coincidence signal is generated when a preset alarm time coincides with the current time. When this occurs, a sequence of electrical signals is produced from a memory circuit. As a result of sequence of tones is emitted by a built-in loudspeaker to constitute a melody. A liquid crystal display section is provided on the timepiece to indicate the pitch of each note of a melody as the various notes are sequentially written into the memory circuit by actuation of external control members. Of these control members, two serve to select the pitch of a note, another serves to select the duration of a note while another serves to actually write into the memory circuit the pitch and duration information which has been thus selected. Another liquid crystal display section serves to indicate the duration which is selected for each note. When each note is written into the memory circuit, that note is audibly generated by the loudspeaker, so that the user can monitor the writing-in of each note of a desired melody. In this way, the timepiece user can easily cause a freely selected melody to be memorized and to be subsequently emitted in audible form as an alarm time indication signal. It is also possible to arrange that a melody thus selected by the user can be a audibly emitted once per hour, on the hour as an hours indication signal, or instead to arrange that an audible chime signal is generated as an hours indication signal. With the preferred embodiment of the present invention, a melody comprising a sequence of up to seventy notes can be memorized and reproduced. However it is also possible to arrange that a melody having a greater number of notes can be memorized, by simple modification of the preferred embodiment.

BRIEF DESCRIPTION OF THE DRAWINGS

In the appended drawings

DESCRIPTION OF THE PREFERRED EMBODIMENT

Figure 1:
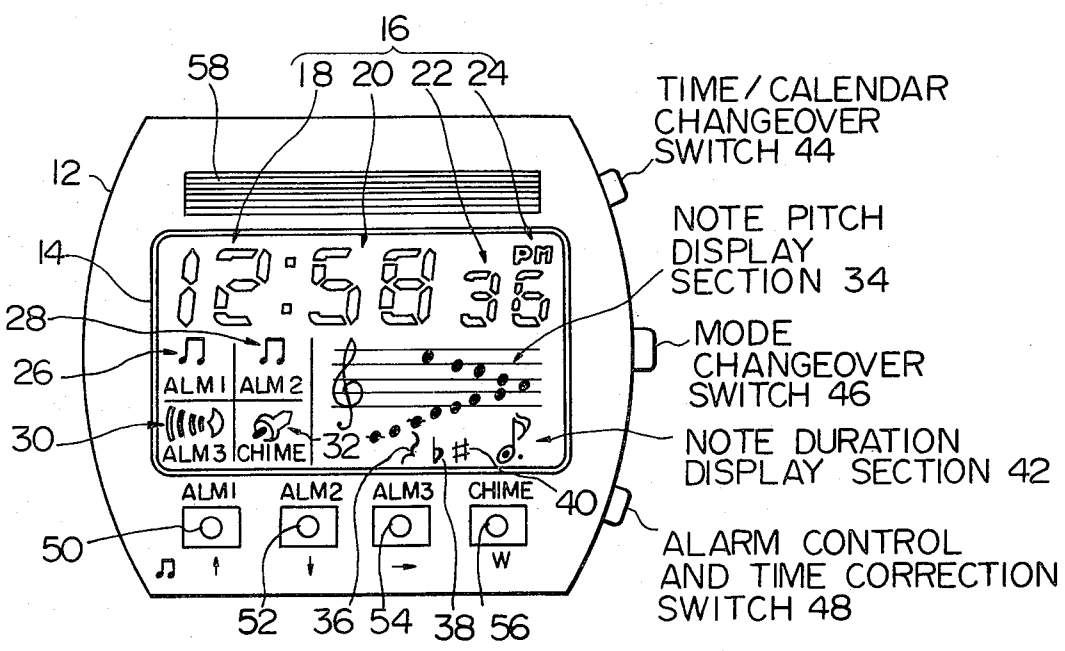
FIG. 1 is an external plan view of an electronic timepiece equipped with a melody function in accordance with the present invention.

Referring now to the appended drawings, FIG. 1 is a planned view illustrating the external appearance of an embodiment of an electronic timepiece equipped with a melody alarm function in accordance with the present invention. Reference numeral 12 denotes an external case which contains a liquid crystal display 14. Liquid crystal display 14 comprises a plurality of display sections for indicating current time, alarm and melody information as described hereinafter. Numeral 16 denotes a time display section for indicating current time information in digital form. Time display section 16 comprises an hours display section 18, a minutes display section 20, a seconds display section 22 and AM/PM display section 24. Numeral 26 and 28 serve to indicate whether a first alarm function and second alarm function respectively are in the operable state. Each of the latter is a melody alarm function, and is indicated by a liquid crystal display pattern in a form of a quaver musical note symbol. Numeral 30 denotes a liquid crystal display pattern indicating a buzzer signal, and serves to indicate when a third alarm function is in the operable state. Numeral 32 denotes a liquid crystal display pattern in the form of a bell symbol, and serves to indicate whether a chime function is in the operable state. With the latter function, a chime sound is audibly emitted once per hour on the hour. Numeral 34 denotes a note pitch display section, which comprises a set of five parallel lines and a musical stave symbol which printed on the display surface, and a number of small liquid crystal display segments, one of which is denoted by the numeral 35. These liquid crystal segments of note pitch display section 34 are used in indicating the pitch of a note when writing in of a melody is being performed, as described hereinafter. Numeral 36 denotes a liquid crystal display pattern in the form of a musical rest symbol, numeral 38 denotes a liquid crystal display pattern in the form of a musical flat "b" symbol, while numeral 40 denotes a liquid crystal display pattern in the form of a musical sharp symbol "#". Numeral 42 denotes a note duration display section comprising a liquid crystal display section which can indicate musical notes of various durations. Display section 42 is used to monitor the duration of each note of a melody as it is written in, by the user. The notations ALM1 and ALM2 are printed on the display surface immediately below the first and second alarm indication display sections 26 and 28, respectively. The designations ALM3 and CHIME are printed on the display surface immediately below the third alarm and chime display sections 30 and 32 respectively. Numeral 44 denotes a time/calendar changeover switch. This is used to select a display of either time information or calendar information by time display section 16, i.e. to select either a time display mode or a calendar display mode. In the calendar display mode, hours display section 18 indicates the month, minutes display section 20 indicates the day of the month and seconds display section 22, which can indicate either digital or alphabetic information indicates the day of the week. Numeral 46 denotes a mode changeover switch, the use of which will be described hereinafter. Numeral 48 denotes an alarm control and time correction switch, which is used in setting in a desired alarm time and in correcting the current time information. Numeral 50 denotes a switch which is used to enter or to leave the first alarm mode, or to increase the pitch of a musical note of a melody being written in, as described hereinafter. Numeral 52 denotes a switch which is used to lower the pitch of a note when writing in is being performed, or to turn the second alarm function on and off. Numeral 54 denotes a switch which is used to select the duration of a note when writing in is being performed or to turn the third alarm function on and off. Numeral 56 denotes a switch which is used to select the chime function, or to write in information concerning a note which has been previously established by means of actuation of switches 50, 52 and 54.

Figure 2:
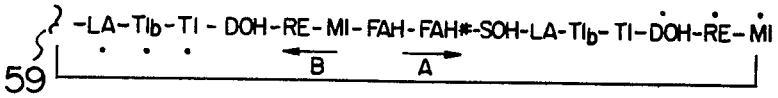
FIG. 2 is a diagram illustrating the manner in which a desired pitch of a note can be obtained for the embodiment of FIG. 1.

Referring now to FIG. 2, the manner of the operating switches 50 and 52 will now be described. It will be assumed that the timepiece has been placed in the melody setting mode, as described hereinafter. In order to raise the pitch of a note, switch 50 is successively actuated. Each time such an actuation is performed, the pitch of the note is raised in the direction shown by arrow A, so that for example, the pitch is raised from "doh" to "re" by one actuation of switch 50, and from "re" to "ti+ by another actuation of switch 50. The pitch of a note can similarly be lowered by actuation of switch 52. In this case, the pitch is lowered in the direction indicated by the arrow B in FIG. 2. This increase or decrease of the pitch is performed in cyclic, recirculating manner, as shown in FIG. 2. For example, if the note pitch "mi" has been selected then a further actuation of switch 50 will result in rest being selected as indicated by symbol 59 in FIG. 2. Subsequent actuation of switch 50 will then cause the notes "la", "ti", etc., to be successively selected. Similarly if the rest has been selected, then further actuation of switch 52 will cause the note "mi" to be selected. Thus, by successive selection of switches 50 and 52 the user can designate the pitch of a note to have any value within the range "la" to "mi" as shown in FIG. 2, or can designate a rest instead of a note. As switches 50 and 52 are actuated to vary the pitch of a note, this pitch is indicated by one of the display segments 35 of note pitch display section 34 becoming visible, i.e. appearing black in colour. The user can thereby visually monitor the process of selecting the pitch of each note of a melody before that pitch information is actually memorized.

Figure 3:
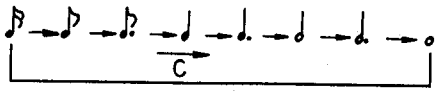
FIG. 3 is a diagram illustrating the manner in which the duration of a note can be selected for the embodiment of FIG. 1.

When the pitch of a note has been selected, as described above, the user can then designate the duration of the note (or rest) thus selected, by actuation of switch 54. The operation of switch 54 is illustrated by FIG. 3. Successive increments of switch 54 cause the duration of the note to be successively increased, thereby determining whether the note is to be a crotchet, a quaver, etc. As shown in FIG. 3, the note duration can be successively selected by actuation of switch 54 in the range from a semiquaver to a note of one-bar duration. The duration selected in this way is indicated on display 14 by note duration display section 42, which displays a musical note symbol corresponding to the duration which has been selected, i.e. if the duration selected for a note corresponds to that of a quaver, then the symbol indicating a quaver is displayed on note duration display section 42.

As described above, the user can select a rest, instead of a musical note, by suitably actuating switches 50 and 52 until the condition indicated by numeral 59 in FIG. 2 is attained. In this case, the symbol 36 is made visible, black in color, to indicate that a rest has been selected. The user can then select a desired duration for this rest, by actuation of switch 54, as in the case of a musical note. When this is done, the duration selected for the rest is indicated by the type of musical note symbol which appears on note duration display section 42.

Having now selected the desired pitch and duration of a note, or the duration of a rest, whichever is the case, the user can write this note or pitch information into a melody memory circuit of the timepiece by actuating switch 56. When this is done then (unless information specifying a rest has been written in), the note corresponding to the information being written in is audibly generated by the loudspeaker located behind a speaker grill 58. The user can therefore audibly monitor whether a note is correct, with respect to pitch and duration, as it is written into the melody memory circuit, as well as being able to visually monitor the information by means of liquid crystal display sections 34, 36, 38, 40 and 42. During the process of writing in the various notes of a melody, successive addresses in the melody memory circuit are sequentially selected. In the present embodiment, the changeover from one address to the next is performed upon the termination of a note being audibly generated by the speaker, after switch 56 has been actuated to write in information specifying a note (or a rest). In the present embodiment, writing in of the notes of a melody begins at a first address of the melody memory circuit, and subsequently up to 69 other addresses can be sequentially designated to receive, in each, information specifying a particular note or rest of the melody.

In the subsequent description of the present embodiment, only the manner in which a melody alarm signal is generated for the first alarm (ALM 1) will be described, for simplicity of description. It will be made apparent that provision of the second melody alarm (ALM 2) can be implemented by duplication or expansion of the configuration whereby the first melody alarm function is provided. In addition, since implementation of the third alarm function (ALM 3) in which only a simple buzzer tone is used as an alarm signal, and implementation of the chime function for indication of the passage of hours by means of a chime audible signal, can both be performed by utilizing conventional arrangements already known in the art for providing such functions in an electronic timepiece, no further description of the manner of implementation of these functions will be provided in the following description.

With the present embodiment, it is possible to specify the semitone notes "Ti♭", "Ti♭", and "Fah♯". If this is done, by suitable actuation of switch 50 or switch 52, as described hereinabove, then the symbol "♭" appears on display section 38, in the case of a flat note having been selected, while the symbol "♯" appears on display section 40 in the case of the sharp note having been selected. With these semitones being included in the notes which can be selected to form a melody, it is possible to write in melodies in the key of C, the key of E and the key of G. It would be easily possible to modify the present invention to include the provision for writing in a larger number of semitone notes, if desired, so that melodies could be written in other keys than those stated above.

Figure 4:
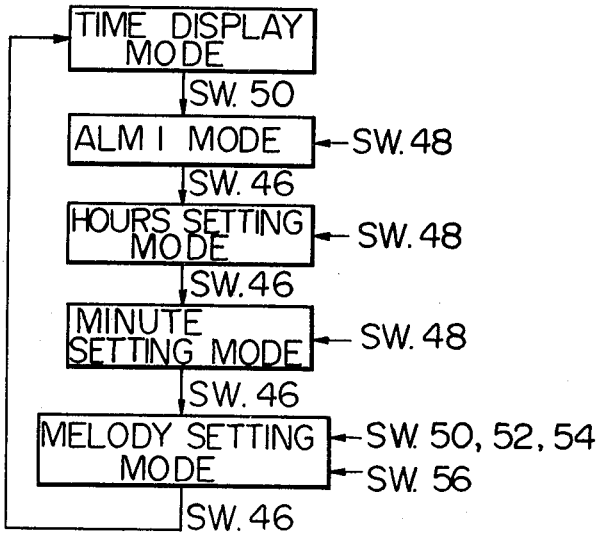
FIG. 4 is a flow diagram illustrating the manner in which various operating modes are selected for the embodiment of FIG. 1.

The manner in which selection is performed of various operating modes of the timepiece whereby alteration of the preset alarm time of the first alarm function (ALM 1) and of the contents of the melody memory circuit can be performed, will now be described, with reference to FIG. 4. FIG. 4 is a flow diagram, illustrating the effects of sequential actuations of switches 46, 48 and 50. As indicated in the first (i.e. topmost) block of FIG. 4, the timepiece is assumed to be initially in the normal time display mode. An actuation of switch 50 will then cause the first alarm (ALM 1) mode to be entered, i.e. the mode of operation in which the first alarm function can be turned on or off, and can have the preset alarm time altered if desired. In this mode, successive actuations of alarm control and time correction switch 48 will alternately turn the first alarm function on and off, i.e. will alternately enable and disenable this function. When the first alarm function is turned on, then this is indicated by the musical note symbol of display section 26 being made visible, black in color, while when the first alarm function is turned off, then the musical note symbol 26 is made invisible. The user can thus turn the first alarm function on or off, as desired, at this point. If switch 46 is now actuated, then the hours setting mode for the first alarm function will be entered. In this mode, the user can, by successive actuations of switch 48, set the alarm time hours for the first alarm function to a desired value. At this time, the alarm time hours and minutes are displayed on sections 18 and 20 respectively of time display section 16 of display 14, so that the user can monitor the effects of actuation of switch 48. A further actuation of swtich 46 will now result in the alarm time minutes setting mode for the first alarm function being entered. In this mode, the user can set a desired value of alarm time minutes by successive actuations of switch 48, while monitoring the effects upon display section 20. A further actuation of switch 46 would, in the case of a conventional electronic timepiece having an alarm function, result in a return to the normal time display mode. However, with this embodiment of the present invention, a further actuation of switch 46 will result in the melody setting mode being entered, in which the user can set in a desired melody to be audibly generated when the previously set in alarm time for the first alarm function coincides with the current time. When the melody setting mode is entered, the first address of the melody memory circuit (to be described hereinafter) is selected to have note or rest information written into it. The manner of writing in this information, by actuation of switches 50, 52 and 54, has been described hereinabove. As information for each successive note or rest is written into the melody memory circuit, the other addresses of the memory are successively designated to receive tone or rest information.

When writing in of a memory, or alteration of a previously stored melody, has been completed, then a further actuation of switch 46 will result in the normal time display mode being returned to, as shown in FIG. 4.

Figure 5A:
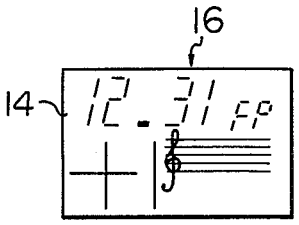
FIG. 5A, 5B, 5C and 5D are diagram illustrating the appearance of the liquid crystal display for the embodiment of FIG. 1 in different operating modes.
Figure 5B:
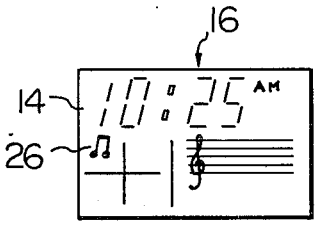
Figure 5C:
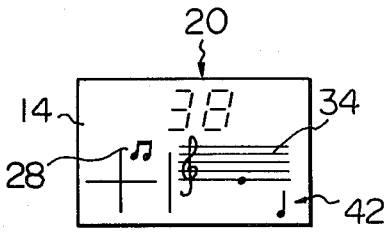
Figure 5D:
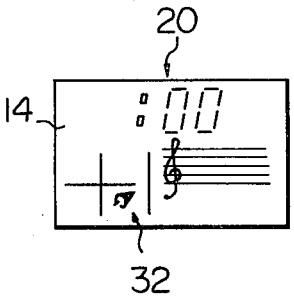

The appearance of display 14 in different operating modes of the timepiece are illustrated in FIGS. 5A to 5D. FIG. 5A shows the appearance in the calendar display mode, indicating a data of Friday, December 31. FIG. 5B shows the appearance of display 14 for the normal time display mode, in which the first alarm function (ALM 1) has been turned on, as indicated by display section 26 being visible as a musical note symbol. FIG. 5C shows the display appearance in the melody setting mode, in which a melody is being set for the second alarm function (ALM 2), as indicated by display section 28 being made visible. The address of the melody alarm circuit into which the next set of note (or rest) designating information will be written in is indicated by display section 20, which in this example is indicating address 38. The pitch which has been selected for the note to be written in is indicated by the liquid crystal display segment on the bottom line of the five lines of note pitch display section 34 being made visible. In addition, the duration which has been selected for this note is indicated by the symbol appearing on note duration display section 42, as shown. FIG. 5D shows the display appearance when the chime mode has been selected. This mode is entered by actuating switch 56. In the chime mode, the chime function, to provide an audible chime signal once each hour, on the hour, can be turned on or off, as the user desires, by actuation of switch 48 in the same way that the first alarm function can be turned on or off, as described above with respect to FIG. 4. When the chime function is turned on, then this is indicated by the chime symbol 32 being made visible, as shown in FIG. 5D.

Figures 6, 6A:
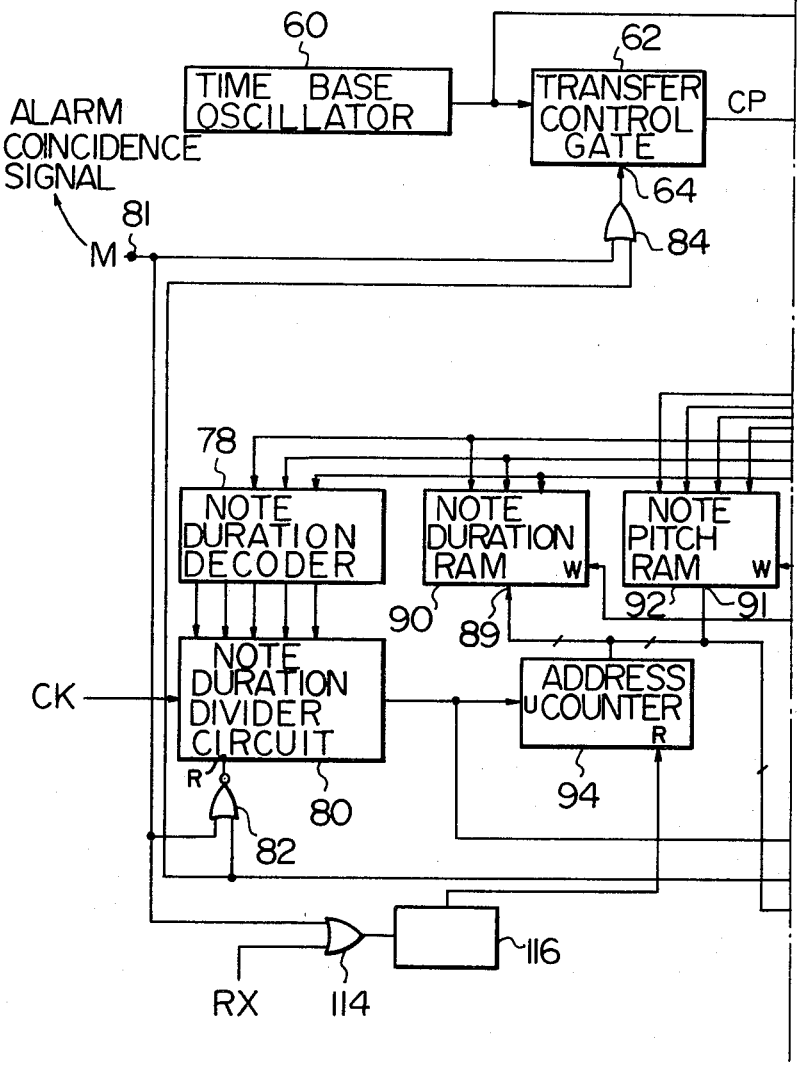
FIG. 6 is a block circuit diagram of an embodiment of the present invention, illustrating portions of the circuitry thereof concerned with the melody function.
Figure 6B:
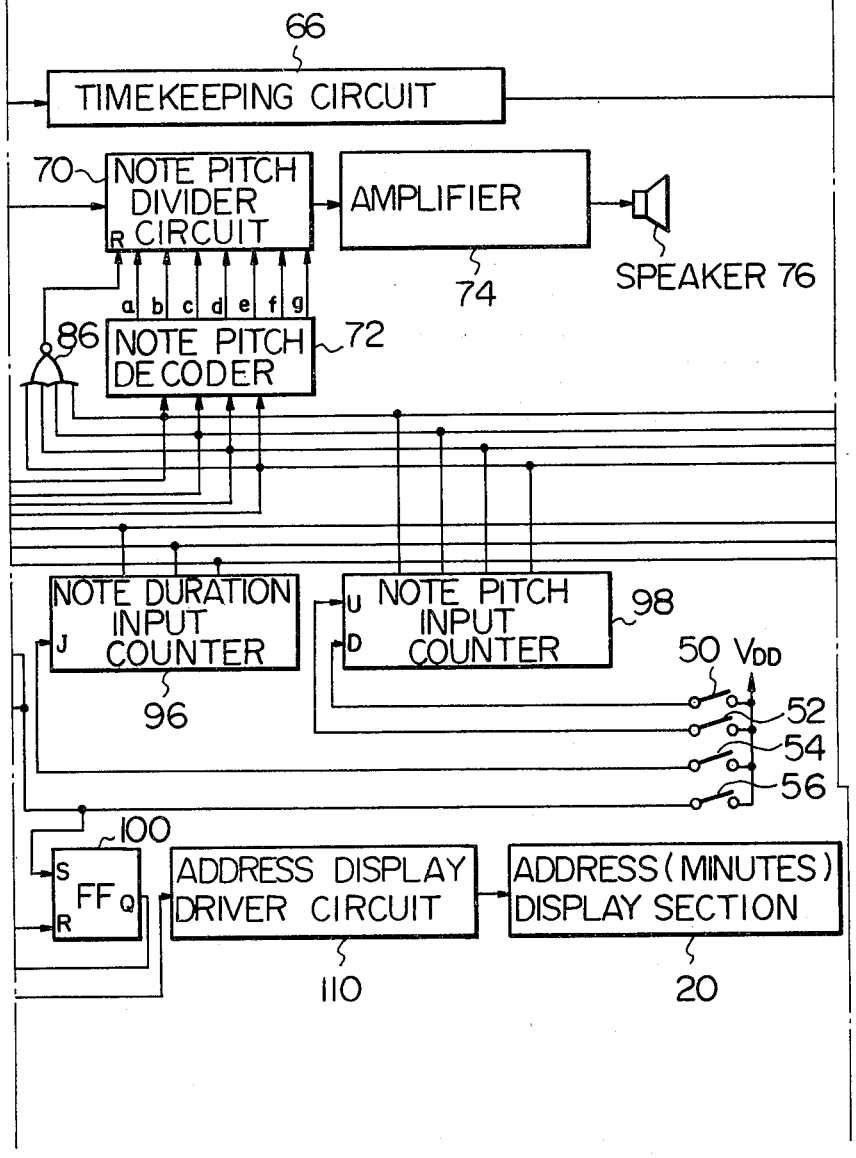
Figure 6C:
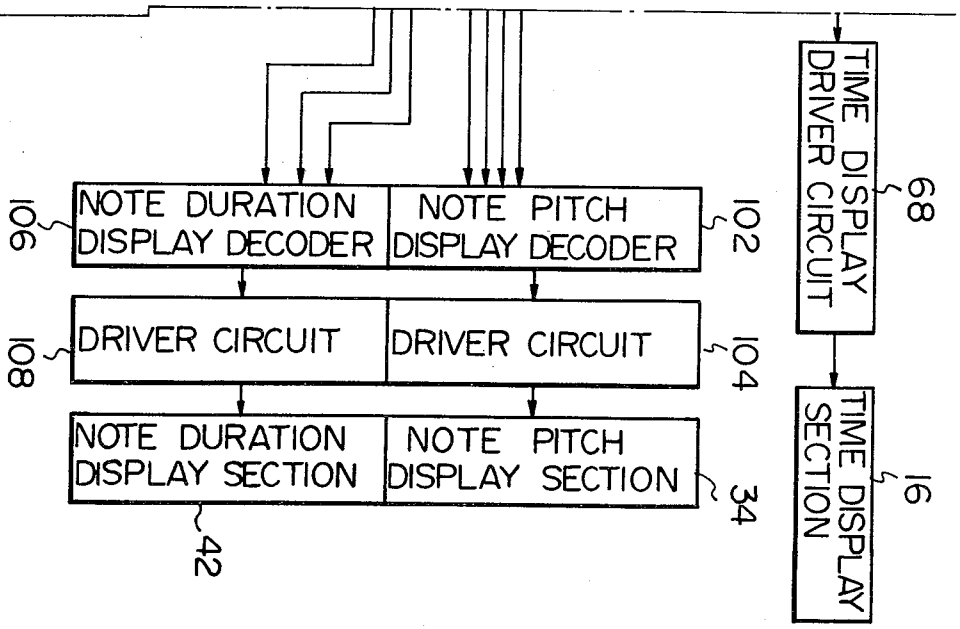

The operation of the melody alarm function for the first embodiment of the present invention will now be described, for the case of a single melody alarm function (e.g. the first alarm ALM 1 or the second alarm ALM 2 of the embodiment of FIG. 1), with reference to the block circuit diagram of FIG. 6. In FIG. 6, reference numeral 60 denotes a timebase oscillator circuit having a quartz crystal vibrator, which produces a standard frequency timebase signal having a frequency of 32.768 kHz. This timebase signal is appplied to a frequency divider circuit of a timekeeping circuit 66, which thereby produces various time information signals indicative of the current time hours, minutes and seconds. These time information signals are applied to a time display/driver circuit 68, which in response produces drive signals which are applied to time display section 16 of liquid crystal display 14, to thereby provide a display of current time information. Timekeeping circuit 66 also produces a train of clock pulses CK, whose function will be described hereinafter.

The timebase signal from oscillator circuit 60 is also input to a transfer control gate 62. Transfer of the timebase signal through this gate is controlled by a signal applied to a control terminal 64 thereof. When this control signal is at a high logic level potential (referred to hereinafter as the H level) then the timebase signal is transferred through gate 62, while when the signal applied to control terminal 64 is at a low logic level potential (referred to hereinafter as the L level), the timebase signal is inhibited from passing through transfer control gate 62. The timebase signal, when transferred out of gate 62, will be designated herein as signal CP.

Numeral 70 denotes a note pitch divider circuit, which serves to frequency divide the signal CP to produce a signal whose frequency corresponds to the pitch of a note which is to be audibly reproduced. A reset terminal R is provided on note pitch divider circuit 70. When this terminal is at the H level, then operation of note pitch divider circuit 70 is inhibited, so that no output signal is produced therefrom. When the signal applied to reset terminal R is at the L level, then operation of note pitch divider circuit is enabled, so that a frequency divided output signal is produced therefrom. Reference numeral 72 denotes a note pitch decoder circuit, which has four input terminals and has seven output lines. The combination of signals appearing on these seven output lines, which are designated as a, b, c, d, e, f and g respectively, determines the frequency division ratio of note pitch divider circuit 70. In other words, note pitch decoder circuit 72 serves to control the division ratio of note pitch divider circuit 70 in accordance with the digital combination of signals which are applied to the four input lines of circuit 72.

Reference numeral 74 denotes an amplifier circuit, which serves to amplify the frequency divided output from note pitch divider circuit 70. The amplified output signal thus produced is applied to a speaker 76, which is located within the speaker grill 58 shown in FIG. 1, so that the note corresponding to the frequency divided output from divider circuit 70 is audibly reproduced.

Reference numerals 78 and 80 denote a note duration decoder circuit and a note duration divider circuit respectively. Note duration decoder circuit 78 decodes a binary signal applied to three input lines, to produce decoded output signals on five output lines. These output signals serve to control the division ratio of note duration divider circuit 80, which acts to frequency divide a clock signal CK, produced by timekeeping circuit 66. Note duration divider circuit 80 is provided with a reset terminal R, which is responsive to an H level control signal applied thereto for inhibiting the operation of note duration divider circuit 80, and is responsive to an L level control signal applied thereto for enabling operation of circuit 80.

The output from note duration divider circuit 80 is applied to an input terminal U of an address counter 94. Address counter 94 is an up-counter circuit, which counts up on successive applications of signals to terminal U. The count of address counter 94 is applied as an address designating signal to address terminals 89 and 91 of first and second random access memory circuits 89 and 91, which together constitute the melody memory circuit referred to hereinabove. The term "random access memory" will be abbreviated hereinafter to RAM. RAM 90 serves to store information specifying the duration of each of the notes or rests in a melody. RAM 92 serves to store the information specifying the pitch of each of the notes in a melody in a corresponding series of addresses. In the case of an address which corresponds to a rest, rather than a note, the contents of this address are set to zero. As shown, information is input to and output from RAM 90 on three data lines, while information is output to and output from RAM 92 on four data lines.

Numerals 50, 52, 54 and 56 indicate the four switches having corresponding reference numeral designations in FIG. 1, whose functions have been described hereinabove. Switch 56 is coupled to the write terminals, designated as W, of RAM 90 and RAM 92, so that actuation of switch 56 causes information to be written in from the four data lines of RAM 92 and the three data lines of RAM 90, when melody information is being memorized.

Reference numeral 96 denotes a note duration input counter, which is used to designate the duration of each note of a melody before this duration information is written into an address of RAM 90. Note duration input counter 96 is an up-counter, which counts up in response to successive actuations of switch 54, which is coupled to a count input terminal U thereof. The count of note duration input counter 96 is output on three lines which are connected to the three data lines of RAM 90.

Reference numeral 98 denotes a note pitch input counter, which is used in selecting the pitch of each note of a melody, before the note is written into RAM 92. Note pitch input counter 98 is of up/down counter type, which counts up in response to successive actuations of switch 52, connected to the up count terminal U thereof, and which counts down in response to successive actuations of switch 50, which is coupled to the down count terminal D thereof. The count of note pitch input counter 98 is output on four lines which are connected to the four data lines of RAM 92, as shown in FIG. 6.

Numeral 100 denotes a set/reset type flip-flop circuit (abbreviated hereinafter to RS FF), which has a set input terminal coupled to switch 56, and which has a reset input terminal coupled to the output from note duration divider circuit 80. The Q output of RS FF 100 is coupled to one input of a NOR gate 82 and to one input of an OR gate 84. The output of NOR gate 82 is coupled to the reset terminal R of note duration divider circuit 80, while the output of OR gate 84 is coupled to the control terminal 64 of transfer control gate 62. Numeral 81 denotes a terminal to which is applied a melody enabling signal, which is this embodiment comprises an alarm conincidence signal designated as M. Signal M is generated by an alarm coincidence detection circuit, when coincidence occurs between the current time and a preset alarm time. This alarm coincidence detection circuit, as well as the means for setting an alarm time, can be implemented by various conventional circuit means, and are therefore not shown in the drawings. The four data lines from RAM 92 are applied to inputs of a NOR gate 86, the output of which is applied to the reset terminal R of note pitch divider circuit 70. The latter four data lines are also input to a note pitch display decoder circuit 102, output signals from which drive the note pitch display section 34 through a display decoder/driver circuit 102.

The three data lines from RAM 90 are input to a note duration display decoder 106, as well as to the note pitch input counter 98 and note duration decoder 78. Output signals from display decoder 106 serve to drive note duration display section 42, described hereinabove.

The address information output from address counter 94 is input to an address display driver circuit 110, output signals from which drive the minutes/address display section 20 to display the current address selected for RAM 90 and RAM 92, when the timepiece is operating in the melody setting mode.

Reference numeral 114 denotes an OR gate, which receives the signal M and a signal RX, the latter signal being generated when the timepiece enters the melody setting mode. The output from OR gate 114 is applied to a differentiator circuit 116, which thereby produces a short pulse at the H level each time the signal M is generated or the timepiece is placed in the melody setting mode. This pulse is applied to a reset terminal R of address counter 94, so that the address is reset to zero each time signal M is generated or the melody setting mode is entered. Signal RX can be produced by various conventional circuit arrangements, and these arrangements are therefore not shown in the drawings.

The operation of the circuit of FIG. 6 will now be described, assuming that the timepiece has just been placed in the melody setting mode, so that address counter 94 has been reset to a count of zero. To set the pitch of the first note of a desired melody, the user actuates switches 50 and 52. Each time switch 50 is depressed, the contents of note pitch input counter 98 are advanced by a count of one, i.e. a count up operation is performed. Each time switch 52 is depressed, the contents of counter 98 are decremented by one, i.e. a count down operation is performed. The count in the pitch input counter 98 is applied through circuit 102 to note pitch display section 34, so that the user can see the results of actuation of switches 50 and 52 by the position of the visible display segment (i.e. segment 36 in FIG. 1) with respect to the five lines of note pitch display section 34, and therefore can visually monitor the pitch which is being selected for a note. If the user wishes to input a rest as the start of the melody, this can be achieved by actuating switches 50 and 52 to obtain the condition indicated by numeral 59 in FIG. 2.

Having now selected the desired pitch for a note, or having selected a rest, instead of a note, the condition thus selected will be represented by the count held in note pitch input counter 98. In this embodiment, a count of zero (where all three output lines from counter 98 are at the L level) represents a rest, while various other count values indicate the other notes which can be selected, as shown in FIG. 2.

The user now selects the duration which is desired for the rest or note which is to begin the melody. This is done by successive actuations of switch 54, to successively increment the contents of note duration input counter 96. The results of these actuations of switch 54 are indicated by the symbol appearing on note duration display section 42.

With the desired pitch and duration having been selected for the first note of the melody, the user can now write in this pitch and duration information to the melody memory circuit, by actuating switch 56. A signal is thereby applied to the write terminal W of RAM 90 and RAM 92, so that the binary signal combination appearing on the four output lines from note pitch input counter 98 are written into the first address (i.e. address 0) of RAM 91 (since the count of address counter 94 has been reset to zero at this point), while the binary signal combination appearing on the three output lines from note duration input counter 96 are written into the address 0 of RAM 90.

Actuation of switch 56 to perform this write operation causes RS FF 100 to be set, so that its output Q goes to the H level. Note duration divider circuit 80, which was previously held in a reset condition by an H level output from NOR gate 82, thereby is enabled to begin counting signal CK, at a division ratio which is set by the output signals from note duration decoder 78, i.e. by the contents of note duration input counter 96. Simultaneously, as well as causing the output of NOR gate 82 to go to the L level to enable divider circuit 80, the Q output from RS FF 100 is applied through OR gate 84 to transfer control gate 62, thereby enabling signal CP to be transferred to the input of note pitch divider circuit 70. If a rest has been selected at the start of the melody, then at this time the four inputs to NOR gate 86, from the output lines of note pitch input counter 98, will all be at the L level, indicating a count of zero. In this case, an H level output will be applied to the reset terminal R of note pitch divider circuit 70, which will thereby be inhibited from further operation. If on the other hand a note of a selected pitch has been designated, by the count in note pitch input counter 98, then note pitch divider circuit 70 will beging frequency division of signal CP, at a division ratio which is set by the output signals from note pitch decoder 72, i.e. in accordance with the count contents of the note pitch input counter 98. In this way, an electrical signal, i.e. a pulse train, will be produced from divider circuit 70, having a frequency which is identical to that of the pitch of the selected note. The latter signal will be amplified by amplifier 74, and audibly emitted by loudspeaker 76. Audible emission will continue until a certain number of clock pulses CK have been frequency divided (i.e. counted) by note duration divider circuit 80, this number of clock pulses CK being determined by the division ratio set by the output signals from decoder 78, i.e. by the contents of note duration input counter circuit 96. When this number of clock pulses CK has been counted, the output from note duration divider circuit 80 which is applied to terminal U of address counter 94 and to the reset terminal of RS FF 100 goes to the H level. Output Q of RS FF 100 therefore returns to the L level, so that the output from NOR gate 82 holds note duration divider circuit 80 in the reset state. Simultaneously, this Q signal also causes the output of OR gate 84 to go to the L level, thereby terminating the supply of clock pulses CP to note pitch divider circuit 70. Further audible generation of the note by loudspeaker 76 is thereby terminated. At the same time, when the output from note duration divider circuit 80 goes to the H level, address counter 94 counts up by one, i.e. the count is advanced from address 0 to address 1. The system is now ready to receive information specifying the pitch or duration of the next note of the melody which is being written in.

By repeating the above series of operations, it will be apparent that each of the notes of a desired melody can be successively written in. As each note is written into the melody memory circuit, by actuation of switch 56, the note is audibly produced by speaker 76, so that the user can visually monitor to check that the correct pitch of note has been written in, with the correct duration. Prior to writing in, the selected pitch and duration for the note (or the duration only, in the case of a rest) are visually displayed by display sections 34, 36, 38, 40 and 42, as described above.

The process by which the melody is automatically reproduced when coincidence occurs between the current time and a preset alarm time will now be described. When alarm time coincidence occurs, signal M goes from the L level to the H level. As a result, transfer control gate 62 is enabled to transfer signal CP to note pitch divider circuit 70, the reset condition of note duration divider circuit 80 is released, and a short pulse is output by differentiator circuit 116 whereby address counter 94 is reset to address 0. This address is displayed (e.g. as 00) by address display section 20, and the contents of address 0 are read out of RAM 91 and RAM 92. The previously selected pitch and duration of the first note of the melody are thereby displayed by display sections 34 and 42 respectively, while a corresponding division ratio for note duration divider circuit 80 is designated by signals from note duration decoder 78 and for note pitch divider circuit 70 is designated by note pitch decoder 72. An electrical signal at a frequency designated by the contents of the first address of RAM 92 is thereby generated by divider circuit 70, for a duration which is determined by the contents of the first address of RAM 90, under the control of note duration divider circuit 80. The first note of the melody is thereby generated by an amplified signal from amplifier 74 being applied to speaker 76. When this note is terminated, by the output of note duration divider circuit 80 going to the H level, then the latter level transition causes address counter 94 to be advanced to the next address, i.e. address 1. The next note of the melody is then audibly reproduced, in the same way as for the first note. If a rest has been designated for the second note of the melody, then since the contents of address 1 of RAM 92 will be zero in this case, an H level output from NOR gate 86 inhibits operation of note pitch divider circuit 70, for a duration determined by the contents of address 1 of RAM 90. Then, at the end of this duration, the output of note duration divider circuit 80 goes to the H level again, thereby advancing address counter 94 to the next address.

In this way, each of the successive notes or rests of a melody which is stored in the melody memory circuit are successively reproduced audibly, after alarm time coincidence occurs. As each note is audibly reproduced, it is indicated on the note pitch and note duration display sections 34 and 42, thereby providing an intriguing and instructive indication of the progress of the melody.

The above description, and the drawing of FIG. 6, apply only to the case of a single melody alarm function being provided, such as ALM 1 or ALM 2 in the embodiment of FIG. 1. However, it will be apparent that a second melody alarm function can be easily provided simply by duplicating the melody alarm circuit and associated circuit blocks shown in FIG. 6, or by increasing the capacity of the melody memory circuit and selecting successive addresses in a first part of the melody memory circuit in the case of the first alarm function and selecting addresses in a second part of the melody memory circuit in the case of the second alarm function.

In this embodiment, the binary weights of 64, 32, 16, 8, 4, 2 and 1 are assigned to the lines a, b, c, d, e, f and g respectively of note pitch decoder 72. Thus, the division ratio of note pitch divider circuit 70 can be set in the range 1/1 to 1/127. A word length of 4 bits has been selected for RAM 92 since it is necessary to store information on 16 different types of note and rests. A word length of 3 bits is selected for RAM 90, since it is necessary to store 8 different durations of tones or rests, as shown in FIG. 3.

Also, since it is necessary to store 8 different types of note duration information, note duration input counter 96 can count from a value of 000 (corresponding to a rest), 001 (corresponding to a quaver) and so on, up to a count of 111 (corresponding to a note of one bar duration).

The five bit lines from note duration decoder can control the division ratio of note duration divider 80 in the range 1/1 (corresponding to a semiquaver note) ½ (a quaver), ¼ (a crotchet), . . . land so on. It should be noted that changing the frequency of clock pulses CK applied to divider circuit 80 will change the tempo of the entire melody.

Figures 7, 7A:
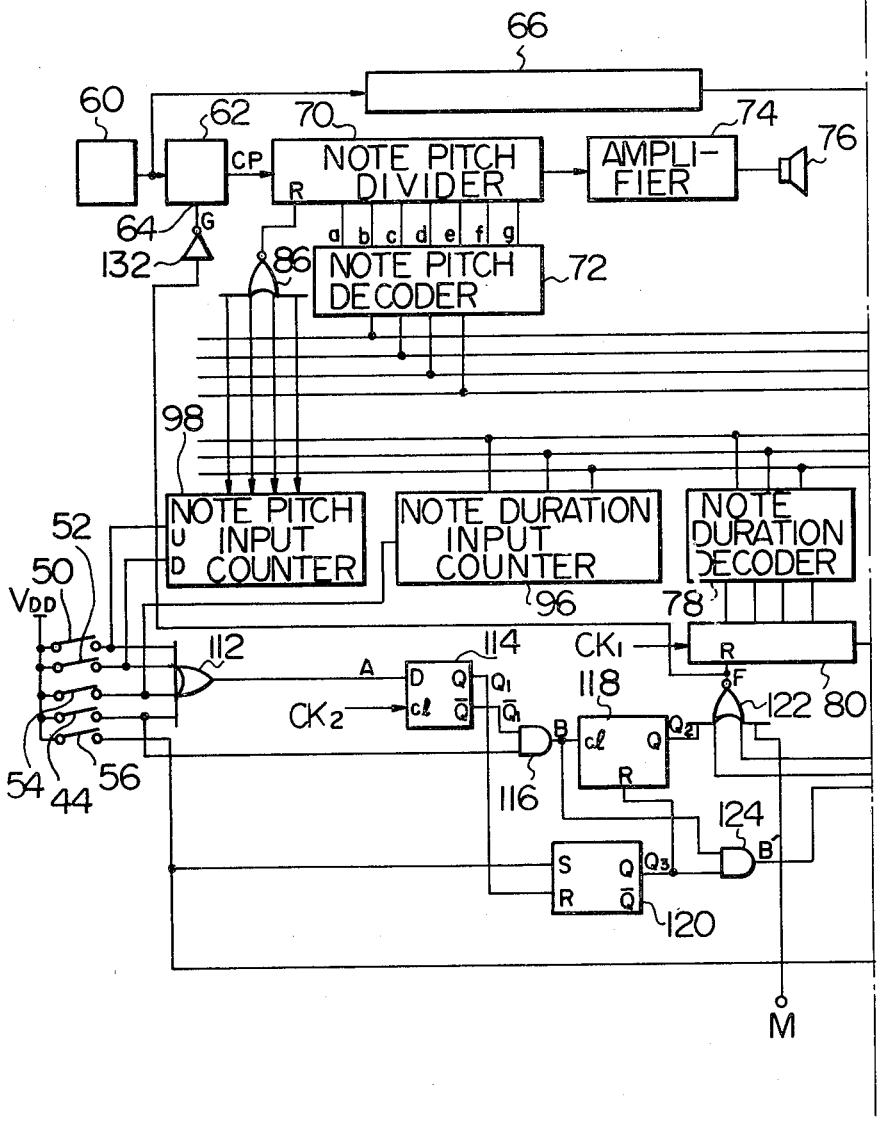
FIG. 7 is a block circuit diagram of another embodiment of an electronic timepiece having a melody function according to the present invention.
Figure 7B:
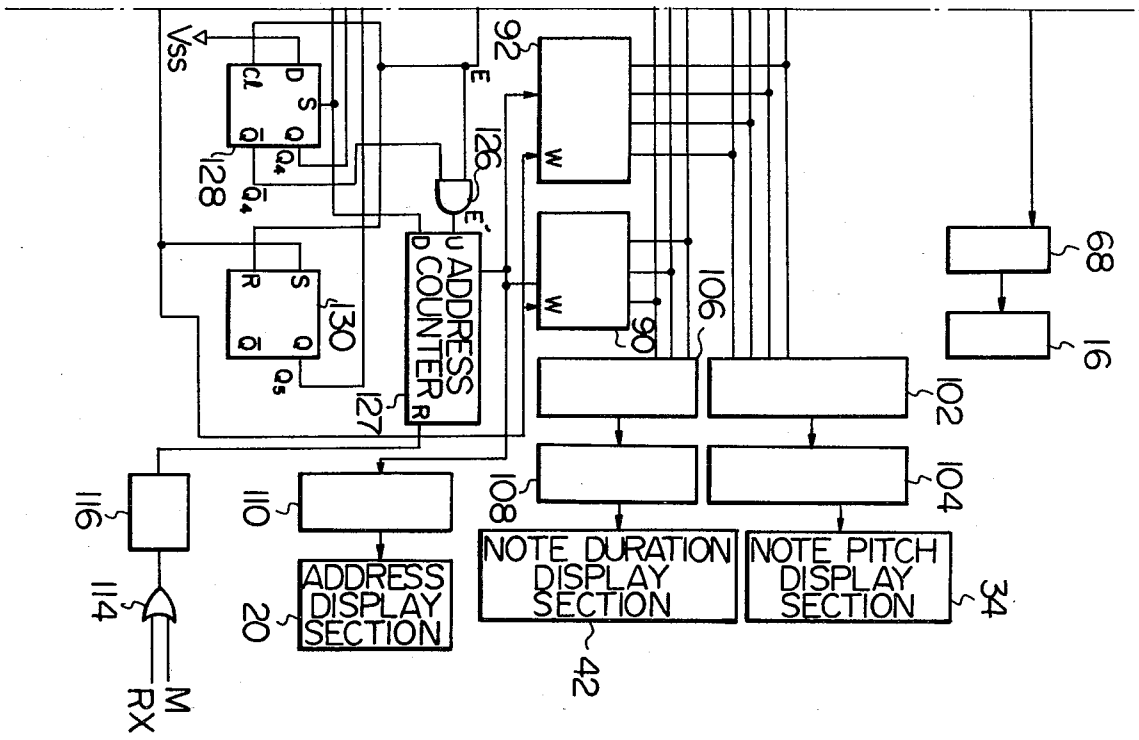

A second example of a circuit arrangement for providing a melody alarm function, for the timepiece embodiment of FIG. 1, will now be described with respect to the block circuit diagram of FIG. 7. In FIG. 7, blocks and components having identical reference numbers to blocks or components in FIG. 6 above have identical functions, and therefore will not be described in detail in the following description. The circuit arrangement of FIG. 7 is basically similar to that of FIG. 6, but is provided with means whereby the user can, after writing in information specifying a note and hearing the note reproduced audibly, immediately set back the address counter by a count of one, so that if desired that note information can be corrected. This facilitates the process of writing in the notes of a melody in a rapid and easy manner.

In FIG. 7, an OR gate 112 receives signals produced when each of the switches 44, 50, 52, 54 or 56 is actuated. The output of OR gate 112 is applied to the data terminal of a data-type flip-flop 114, the $\overline{Q}$ output of which is applied to the reset terminal of an RS FF 120, and the inverting Q output of which is applied to one input of an AND gate 116. The output of AND gate 116, designated as signal B, is applied to the clock terminal of a toggle-type flip-flop 118, the Q output of which is applied to one input of a NOR gate 122, the output of which is applied to the reset terminal of note duration divider 80. Signal B, and the Q output of FF 120 are input to an AND gate 124, the output of which, designated as signal B', is applied to the set terminal of a data-type flip-flop 128. The Q output of FF 128 is applied to one input of NOR gate 122. The output signal from note duration divider 80, designated as signal E, is applied to one input of an AND gate 126, the output signal from which, E', is applied to the up-count terminal of an up-down counter 127 which serves as the address counter in this embodiment. The inverting $\overline{Q}$ output from FF 128 is applied to the other input of AND gate 126. Signal B' is also applied to the down-count terminal of address counter 127. Switch 56 is coupled to the set terminal of an RS FF 130, which receives signal E at its reset terminal. The output from FF 130 is applied to one input of NOR gate 122. In this embodiment, switch 44 is also used in the melody writing process as described hereinafter, and is coupled to one input of AND gate 116.

Alarm coincidence signal M is applied to one input of OR gate 114 and to NOR gate 122. The output from OR gate 114, as in the first embodiment, is applied through a differentiator circuit 116 to reset address counter 127 to address 0.

The output from NOR gate 122 is also applied, through an inverter 132, to control terminal 64 of transfer control gate 62.

The operation of this embodiment, in the case of writing in a melody to the melody memory circuit (RAM 90 and RAM 92) will now be described. When the melody setting mode is entered, then a signal RX is generated, which resets the address counter 127 to the first address of the melody memory circuit, as in the first embodiment. The duration and pitch of the first note of the melody are then specified, by actuation of switches 50, 52 and 54, while visually monitoring the display 14, also as in the case of the first embodiment. When switch 56 is then actuated, the counts in note pitch input counter 98 and in note duration input counter 96 are written into RAM 92 and RAM 90 respectively, in the first address. At the same time, this actuation of switch 56 sets RS FF 130, so that signal Q5 from this FF goes to the H level, causing the output of NOR gate 122 to go to the L level, so that note duration divider circuit begins to count clock pulses CK. During this time, the output of inverter 132 is at the L level, so that pulses CP are input to note pitch divider 70, so that the first note is audibly generated by speaker 76. When the specified duration has elapsed, signal E from note duration divider circuit 80 goes to the H level, thereby resetting RS FF 130, and inhibiting transfer control gate 62. A low level potential is continuously applied to the data input of data-type FF 128, so that at this time the inverting $\overline{Q}$ output of this FF is at the H level. Thus, signal E' and AND gate 126 goes to the H level with signal E, so that address counter 127 counts up by one, to the second address of the melody memory. In this way, successive notes of the melody can be sequentially written in and monitored, as in the case of the first embodiment.

Each time switch 44 is actuated, a pulse having a width equal to one cycle of signal CK2 (applied to the clock terminal of FF 114) is generated from AND gate 116, as signal B. The output of FF 118 goes alternately to the H and the L levels in response to successive B pulses. Normally, the output Q2 from FF 118 is at the L level, since output Q3 from FF 120 will normally be at the H level due to FF 120 having been set by actuation of switch 56. In this condition, if the melody setting mode is entered and then switch 44 is actuated, a B signal pulse will set the signal Q2 to the H level, thereby causing the output of NOR gate 122 to go to the L level, in the same way as if an alarm coincidence signal M had gone to the H level. Thus, sequential audible generation of notes in accordance with the information stored in the successive addresses of the melody memory circuit will be performed, so that the user can monitor the entire melody in a continuous manner by actuation of switch 44. This monitoring can be terminated at any time by actuating switch 44 once more, thereby setting signal Q2 to the L level, or by actuating switch 56 to set output Q3 from FF 120 to the H level, thereby resetting FF 118.

In this way, monitoring can be started and stopped at any point in the melody, simply by actuation of switch 44.

The method of partial correction of the melody memory contents will now be described. Such correction can be performed, in the course of continuous monitoring, described above, or during the process of writing in a melody, when an error is detected after switch 56 has been actuated to write in information on a particular note. To perform such partial correction, switch 56 is first actuated. FF 118 is thereby held in the reset state by the output Q3 from FF 120. Switch 44 is now actuated, generating a B signal pulse, which is passed through AND gate 124 (now in the enabled condition) to produce a B' signal pulse. This pulse sets FF 128, so that signal $\overline{Q4}$ goes to the L level, thereby inhibiting AND gate 126 from transfer of signal E. At the same time, this B' signal pulse is applied to the down-count terminal of address counter 127, so that the count is decremented to that of the previous address.

Thus, if the user should detect an error when writing in note information by actuating switch 56, a single actuation of switch 44 will then cause the address containing the error information to be returned to. Correct information can then be written into that address, and the process of writing in the melody can continue.

When such a partial correction is performed, then as stated above, FF 128 is set by signal B'. FF 128 is of negative-edge triggered type, so that a L-to-H level transition of signal E has no effect upon it. When signal E is returned to the L level after a count-down operation of address counter 127 has been performed in the partial correction process, then FF 128 goes to the reset state as a result, so that signal Q4 again enables AND gate 126 to pass signal E.

In order to go from the partial monitoring mode of operation described above, to the sequential, continuous monitoring mode in which the entire melody can be reproduced continuously, it is only necessary to actuate any of switches 50, 52, 54 or 44 once, and then actuate switch 44. These actions first set FF 114, thereby resetting FF 120 and hence allow an actuation of switch 44 to set signal Q2 from FF 128 to the H level.

In the embodiment described hereinabove, it has been assumed that a signal enabling a melody to be audibly reproduced is generated when an alarm time coincidence condition occurs. However, it is equally possible to arrange that the melody enabling signal is generated to indicate hourly intervals, by being generated once per hour, on the hour, i.e. to provide a melody signal when the timepiece is operating in the "chime" mode.

It will be apparent that various changes and modifications may be made to the embodiments of the present invention described above, but that such changes and modifications would fall within the scope which is claimed for the present invention, as defined in the appended claims.

What is claimed is:

1. In an electronic timepiece including means for generating a standard frequency timebase signal and timekeeping circuit means for generating signals indicative of current time information from said timebase signal, a system for audible generation of a melody, comprising:

externally actuated input means for manual input in a sequential manner of melody information specifying each of a sequence of notes and rests which constitute said melody;

melody memory circuit means for storing said melody information which is sequentially input from said externally actuated input means;

read-out means for sequentially reading out said melody information stored in said memory means specifying said notes and rests of said melody and comprising an address counter whose count contents designate an address of said random access memory means;

drive signal generating means responsive to said melody information for generating a drive signal comprising a series of electrical signals each corresponding to a note of said melody;

sound generating means coupled to receive said drive signal;

a source of a melody enabling signal;

externally actuated monitor switch means for starting and stopping audible generation of said melody at any desired point in the sequence of notes comprising said melody, by controlling said address counter and said first and second control circuit means; and electro-optical display means for displaying the current address of said melody memory circuit contained in said address counter;

said externally actuated input means comprising externally actuatable note pitch selection switch means;

an externally actuatable note duration selection switch;

an externally actuatable write-in switch;

a note pitch input counter, responsive to actuation of said note pitch selection switch means for having a count therein incremented and decremented; and a note duration input counter, responsive to actuation of said note duration selection switch for having a count therein incremented;

said melody memory circuit means being responsive to actuation of said write-in switch for having the current counts of said note pitch input counter and said note duration input counter stored in a predetermined memory location therein;

said read-out means being responsive to said melody enabling signal for sequentially reading out said melody information from said melody memory circuit means, whereby said drive signal is applied to said sound generating means to thereby reproduce said melody audibly.

2. A system for audible generation of a melody according to claim 1, and further comprising electro-optical display means for displaying said melody information as said information is sequentially input by said externally actuated input means, to enable visual monitoring of said sequential information input.

3. A system for audible generation of a melody according to claim 1, wherein said melody memory circuit means comprises random access memory means, and wherein said melody information comprises note duration information specifying the duration of each note of said melody and note pitch information specifying the pitch of each note of said melody.

4. A system for audible generation of a melody according to claim 1, wherein said drive signal generating means comprises first and second control circuits, said first control circuit being responsive to said pitch information read out from said melody memory circuit for producing said drive signal at a frequency corresponding to the pitch of a note of said melody, said second control circuit being responsive to said note duration information read out from said melody memory circuit for controlling the duration of production of said drive signal by said first control circuit means by terminating operation of said first control circuit after a time interval specified by said note duration information, and further wherein said address counter is responsive to said termination of operation of said first control circuit by said second control circuit for being advanced to a count corresponding to an immediately succeeding address of said melody memory circuit.

5. A system for audible generation of a melody according to claim 1, and further comprising means for writing in melody information by said externally actuated input means, to an address specified by the current count of said address counter, when said audible generation of the melody has been stopped by actuation of said monitor switch means.

6. A system for audible generation of a melody according to claim 4, wherein said first control circuit comprises a note pitch divider circuit consisting of a frequency divider circuit whose division ratio is presettable, coupled to receive a first clock signal generated by said timekeeping circuit means, and a note pitch decoder circuit which is responsive to said note pitch information read out from said random access memory means for producing output signals to control the division ratio of said note pitch divider circuit in accordance with said note pitch information.

7. A system for audible generation of a melody according to claim 4, wherein said second control circuit comprises a note duration divider circuit comprising a frequency divider circuit whose division ratio is presettable and which is coupled to receive a second clock signal from said timekeeping circuit, and a note duration decoder circuit which is responsive to said note duration information read out from said random access memory means for producing output signals to control the division ratio of said note duration divider circuit, whereby said note duration divider circuit produces an output signal after a number of cycles of said second clock signal determined by said note duration information have been input thereto, said output signal being applied to said address counter to advance the count therein to that of a succeeding address.

8. A system for audible generation of a melody according to claim 3, wherein said random access memory means comprises first random access memory means for storing information specifying the pitch of each of a series of notes of a melody in a sequentially arranged set of addresses therein, and second random access memory means for storing information specifying the duration of each of said notes in a sequentially arranged set of addresses therein.

9. A system for audible generation of a melody according to claim 6, and further comprising a transfer control gate circuit coupled to control the supply of said first clock signal to said note pitch divider circuit, said transfer control gate circuit being responsive to said melody enabling signal for supplying said first clock signal to said note pitch divider circuit.

10. A system for audible generation of a melody according to claim 9, and further comprising circuit means responsive to said melody enabling signal for resetting said address counter to a predetermined initial address count upon the initiation of said melody enabling signal, whereby the information specifying the notes and rests of a previously stored melody are successively read out from addresses of said melody memory circuit beginning from said initial address.

11. A system for audible generation of a melody according to claim 1, wherein said sound generating means comprises a loudspeaker, and wherein said drive signal means includes an amplifier circuit for producing said drive signal.

12. A system for audible generation of a melody according to claim 2, wherein said electro-optical display means comprises five lines of a musical scale printed upon a surface of said display means, and a plurality of display segments one of which is selectively activated to indicate the pitch of a note whose pitch information is to be stored in said melody memory circuit means.

13. A system for audible generation of a melody according to claim 12, and further comprising an electro-optical display symbol on said electro-optical display means to indicate the duration of a note whose duration information is to be stored in said melody memory circuit means.

14. A system for audible generation of a melody according to claim 1, in which said melody enabling signal is generated upon coincidence occurring between the current time displayed by said timepiece and a preset alarm time.

15. A system for audible generation of a melody according to claim 1, in which said melody enabling signal is generated once per hour, on the hour, to provide an hours indication audible signal.

* * * * *